United States Patent [19]

Scherer et al.

[11] 4,001,750

[45] Jan. 4, 1977

[54] CORROSION RESISTANT MEANS IN EXHAUST CONTROL DEVICE FOR CIRCUIT INTERRUPTING DEVICES

[75] Inventors: Henry W. Scherer, Chicago, Mount Prospect; Roy T. Swanson, North Riverside, both of Ill.

[73] Assignee: S & C Electric Company, Chicago, Ill.

[22] Filed: Sept. 2, 1975

[21] Appl. No.: 609,599

[52] U.S. Cl. ..... 337/280; 337/282

[51] Int. Cl.[2] ..... H01H 85/38

[58] Field of Search ..... 337/203, 249, 250, 273, 337/280, 281, 282

[56] References Cited

UNITED STATES PATENTS

| | | | |
|---|---|---|---|
| 3,230,331 | 1/1966 | Lindell | 337/280 X |
| 3,258,568 | 6/1966 | Patterson et al. | 337/280 X |
| 3,391,368 | 7/1968 | Fahnoe | 337/280 X |
| 3,719,912 | 3/1973 | Harner et al. | 337/282 X |
| 3,783,342 | 1/1974 | Thiel et al. | 337/280 X |

*Primary Examiner*—George Harris
*Attorney, Agent, or Firm*—Kirkland & Ellis

[57] ABSTRACT

An improvement in an exhaust device to absorb the energy of exhaust gases released during operation of a circuit interrupting device such as a power fuse or an expulsion fuse is disclosed. The exhaust control device includes a hollow housing coated with a corrosion resistant coating mounted to the circuit interrupting device by means of an adapter, composed of a corrosion resistant material such as brass, which is retained in a counterbore within the housing by rolling or folding over the extended upper rim of the housing so that the coating is not damaged. Alternatively, a steel header, welded to and plated along with the steel housing shell, within which the threaded brass adapter is installed, may also be used. The same rolling or folding operation may be used to secure a plated outlet end wall. Baffles positioned within the housing for partitioning the housing into chambers for cooling and filtering the hot exhaust gases, for changing the direction of flow of the gases and for attenuating sound are held in place by crimping the hollow housing around the baffles so that the plating is not damaged. An annular expansion space formed between the hollow housing and an inner cylindrical shell increases the surface area of the hollow housing which is exposed to the blast of exhaust gases emitted from the fuse and provides an additional expansion chamber for receiving the exhaust gases produced by the interrupting device. A labyrinth plate with circumferential notches formed therein and arcuate ridges formed within and adjacent to said notches, forms gas diverting channels and a labyrinth flow pattern exhaust path to the exit ports formed within an outlet end wall.

27 Claims, 13 Drawing Figures

CORROSION RESISTANT MEANS IN EXHAUST CONTROL DEVICE FOR CIRCUIT INTERRUPTING DEVICES

BACKGROUND OF THE INVENTION

1. Field of the Invention

The present invention relates to exhaust control devices for high voltage circuit interrupting devices, and, more particularly, the present invention relates to exhaust control devices for high voltage electrical fuses, such as power fuses or expulsion fuses.

2. Description of the Prior Art

The present invention constitutes an improvement over the construction disclosed in Copending Aplication Ser. No. 564075 - Chabala, et al., entitled EXHAUST CONTROL DEVICE FOR CIRCUIT INTERRUPTING DEVICES, filed Apr. 1, 1975, and assigned to the same assignee as the present application.

It is well known in the art that it is desirable to prevent discharge into the atmosphere of the hot arc products and gases resulting from the operation of a circuit interrupting device. It is also desirable to reduce the noise level incident to the operation of and to absorb substantialy all of the energy of the arc products resulting from an expulsion fuse, thus preventing the hot arc products and metallic vapors from entering the atmosphere. The exhaust control device must preferably reduce the sound level and the gas discharge without significantly interfering with the intended circuit interrupting function of the fuse.

It is a desirable advance in the art to provide an exhaust control device which is capable of functioning repeatedly without loss of effectiveness and which is economical to manufacture as a result of the use of small quantities of expensive materials and the use of economical construction methods made possible by an improved structural configuration such that a corrosion resistant device may be provided at reduced cost. The connection between the circuit interrupter and the exhaust control device must resist corrosion so that the exhaust control device can be removed and reused following operation of the circuit interrupter.

BRIEF SUMMARY OF THE INVENTION

An improved exhaust control device in accordance with the present invention for use with a circuit interrupting device comprises a hollow housing coated with corrosion resistant coating having an inlet end wall, within which is formed an intake port for receiving a stream of hot exhaust gases resulting from the operation of the circuit interrupter, and having an outlet end wall, within which are fomred exit ports for venting the exhaust gases to the atmosphere. The outlet end wall is also coated with a corrosion resistant coating. The inlet and outlet end walls are attached to the hollow housing between a counterbore within said housing and an extended rim which is folded or rolled over the end walls so that the corrosion resistant coating on the housing is not damaged. This means of securing the end walls permits simple and economic manufacture of the exhaust control device, while not compromising the corrosion resistant properties of the coated housing. An alternative inlet end wall may be provided which comprises a header which is welded to the hollow housing and coated with corrosion resistant coating at the same time as the hollow housing. The header threadedly engages an adapter, made of corrosion resistant material which engages the circuit interrupter to receive the hot exhaust gases produced by the operation thereof. This construction of the inlet end wall requires less of the expensive corrosion resistant material thereby decreasing the cost of the inlet end wall. The hollow housing contains at least one baffle for partitioning the housing into a plurality of chambers for cooling and filtering the hot exhaust gases, for changing the direction of the flow of the gases, and for attenuating sound. The baffles are secured in place within said housing by a crimping operation, which provides for simple and economical manufacture while preserving the corrosion resistant coating on the housing.

An additional peripheral expansion chamber within the hollow housing may be provided, which is defined by a first and a second baffle plate, an inner shell, and the hollow housing. Peripheral slots in the first baffle communicate with the initial gas expansion chamber directly downstream of the intake port. The peripheral expansion chamber provides an additional volume for the initial expansion of the hot gases emitted by the operation of the circit interrupter, and an increased surface area of the hollow housing for heat to be transferred to the outer atmosphere. This additional volume reduces the strain on the remaining elements of the exhaust control device. Further, the fact that the gas must exit through the same peripheral slots in the first baffle through which it entered, prolongs the passage of the gas through the exhaust control device with an accompanying reduction in the violence resulting therefrom.

A labyrinth baffle connected to the outlet end wall and located upstream thereof is provided comprising a plurality of peripheral notches formed thereon and a plurality of ridges formed therein radially adjacent to the peripheral notches. The ridges form channels between the labyrinth baffle and the outlet end wall and are located radially from the exit ports formed in the outlet wall, thereby defining gas flow diverting channels and a labyrinth flow pattern for the exhaust gases exiting the exhaust control device. This constuction, utilizing a set of ridges formed on the baffle, provides a simple and economical means for further attenuating the sound produced by the operation of the circuit interrupter and for controlling the release of the exhaust gases by the necessarily turbulent flow of the gas through the labyrinth formed thereby.

Thus it is a primary object of the present invention to provide an improved exhaust control device for a circuit interrupter, which has a smaller volume and uses smaller quantities of relatively expensive corrosion resistant materials, which can be easily disengaged from the circuit interrupting and may be used repeatedly.

It is a further object of the present invention to provide improved capacity for heat transfer between the initially expanding exhaust gases and the atmosphere through the housing of the exhaust control device.

A further object of the present invention is to provide improved silencing efficiency and controlled venting without reducing the effectiveness of the circuit interrupter in interrupting the current flow.

Another object of the present invention is to provide an exhaust control device which achieves the above objectives while being simple and economical to manufacture. Yet a further object of this present invention is to provide a corrosion free exhaust control device that may be economically fabricated without comprising the corrosion resistant properties.

DETAILED DESCRIPTION OF THE PREFERRED EMBODIMENTS

Figure 1:
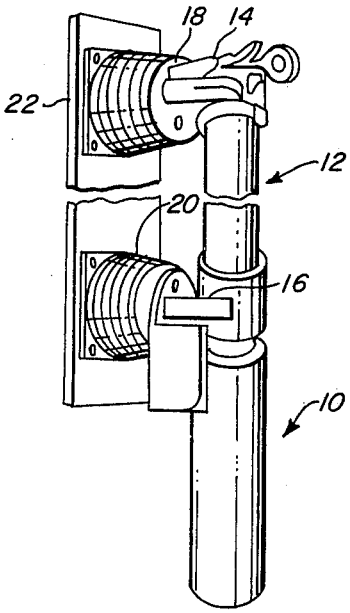
FIG. 1 is a partial fragmentary left perspective view of a high voltage fuse having an embodiment of an exhaust control device in accordance with the present invention attached thereto.

With reference to FIG. 1, exhaust control device 10 is attached to the base of high voltage fuse 12. Fuse 12 is of conventional design and is mounted between an upper terminal 14 and a lower terminal 16. Upper and lower terminals 14 and 16 are mounted on insulators 18 and 20, each of which is mounted on appropriate mounting structure 22. Upper terminal 14 is typically connected to a high voltage conductor (not shown), and lower terminal 16 is similarly connected to a high voltage conductor (not shown), thereby forming a high voltage electrical circuit through fuse 12. Fuse 12 may be of any conventional power fuse design, such as an explusion fuse which produces exhaust gases upon operation of the fuse to interrupt current flow therethrough. For example, U.S. Pat. No. 3,719,912—Harner et al., describes one type of fuse in connection with which the present invention could be used.

Figure 2:
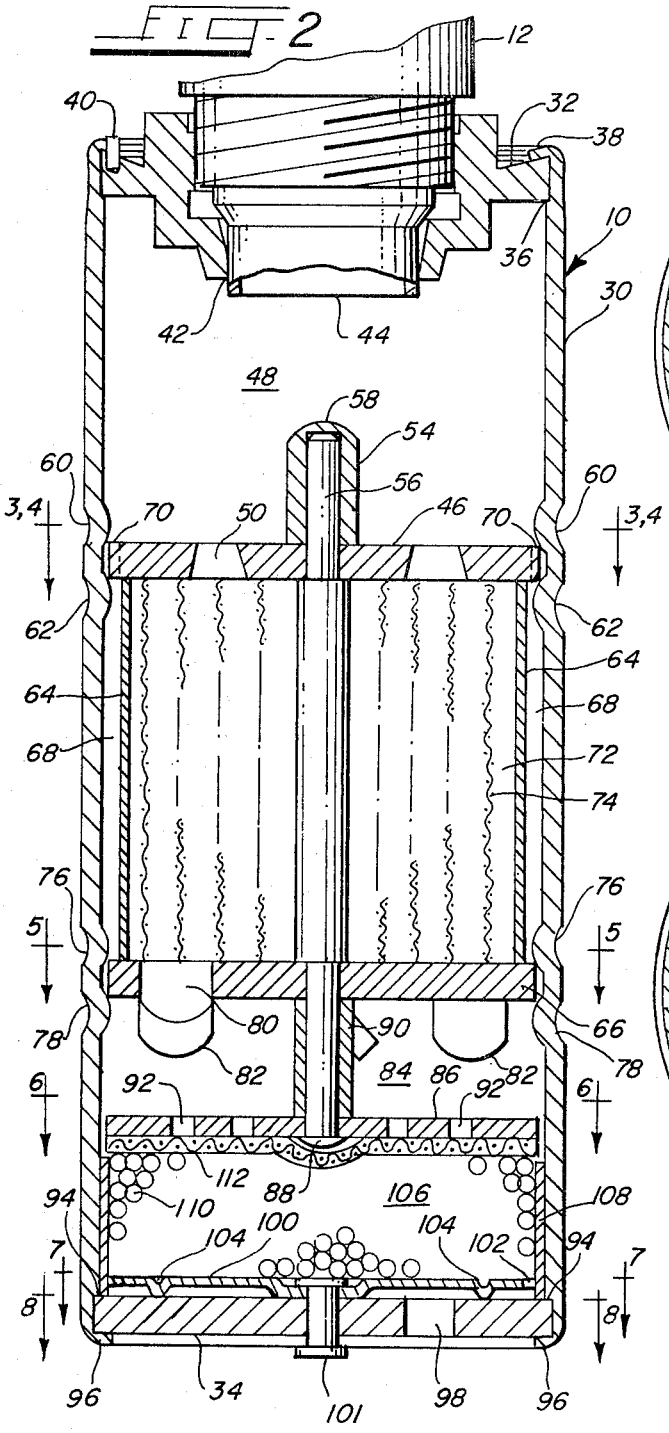
FIG. 2 is a cross-sectional view of one embodiment of the present invention.

With reference to FIG. 2, exhaust control device 10 comprises hollow cylindrical housing 30, inlet end wall 32, and outlet end wall 34. Cylindrical housing 30 is composed of steel and coated with a corrosion resistant coating such as zinc. Such coating may include any of the well known coating processes such as plating, dipping, etc. Similarly, outlet end wall 34 is composed of steel and coated with a corrosion resistant coating. Inlet end wall 32 is composed of a corrosion resistant material, such as brass or silver-plated brass, and is attached to housing 30 by means of counterbore 36 and the rolling or folding of rim 38 of housing 30 over the circumference of inlet end wall 32. This folding operation does not damage or reduce the corrosion resistant properties of the coating. Pin 40 holds inlet end wall 32 in place to prevent rotation within the annular indentation formed by counterbore 36 and rim 38. Formed through inlet end wall 32 is intake port 42 through which extends hollow base extension 44 of fuse 12. When fuse 12 operates to interrupt current flow, hot exhaust gases are expelled through hollow base extension 44 into exhaust control device 10. Inlet end wall 32 is formed of a corrosion resistant material so that fuse 12 will not become corroded or frozen to device 10.

Figure 3:
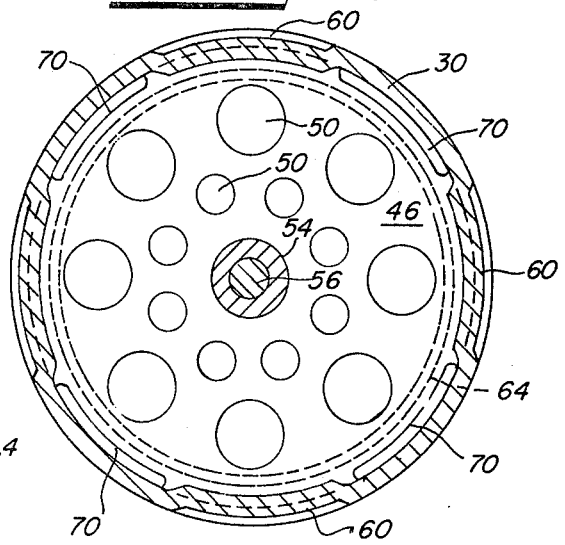
FIG. 3 is a cross-sectional view taken substantially along line 3—3 in FIG. 2.
Figure 4:
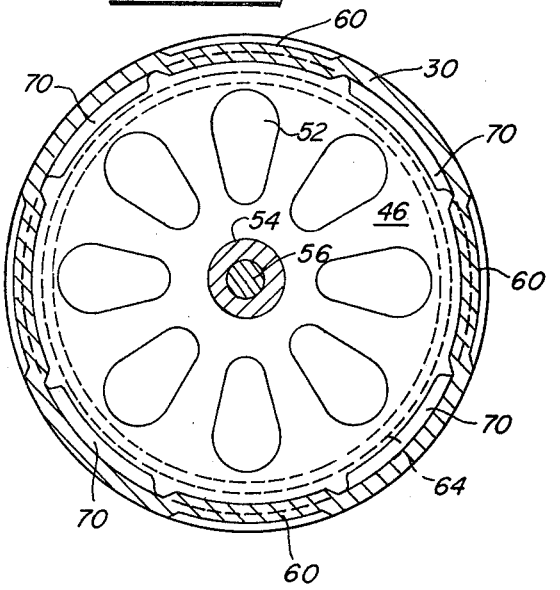
FIG. 4 is a cross-sectional view taken substantially along line 4—4 in FIG. 2.

Baffle plate 46, inlet end wall 32, and housing 30 form gas expansion chamber 48. Baffle plate 46 which is also coated with a corrosion resistant coating has circular openings 50 formed therethrough and equally spaced around two separate radii, as shown in FIG. 3. Circular openings 50 are arranged to have greater flow area toward the outer diameter of baffle plate 46 in order to compensate for the fact that the exhaust gas blast resulting from the operation of fuse 12 is more intense toward the center of baffle plate 46. This arrangement tends to equalize the flow of gas into the next chamber. FIG. 4 shows an alternative embodiment of baffle plate 46 which achieves a similar effect by means of tapered openings 52 which are wider at the outer diameter than they are toward the center of the plate.

Mounted at the center of baffle plate 46 is arcing tip 54 which serves as a point upon which an electrical arc blown into exhaust control device 10 can settle. Without arcing tip 54, the electrical arc could settle on the interior of housing 30 and burn a hole therethrough, which would result in component failure. Arcing tip 54 is secured to central core pin 56 by interference fit.

Baffle plate 46 is held in place within housing 30 by means of crimps 60 and 62 formed in housing 30. Crimps 60 and 62 need not encompass the entire circumference of housing 30 but may be segmented, as shown in FIGS. 3 and 4. The crimps may be relatively shallow and may be formed by means of a pressing operation. With properly contoured forming dies, the coated finish, which is required to prevent corrosion of steel housing 30, will not suffer damage, and the corrosion resistance of housing 30 will not be damaged or compromised. This is especially important because exhaust control device 10 will typically be exposed to extremes of temperature and humidity and to corrosive atmospheres. If a welding operation were used to mount the various elements in housing 30, heat damage would affect the corrosion resistant coating eventually resulting in corrosion damage to the exhaust control device.

Baffle plate 46, housing 30, inner cylindrical shell 64, and vortex-producing baffle plate 66 form annular expansion chamber 68. Circumferential slots 70, formed within baffle plate 46, permit exhaust gases to pass from gas expansion chamber 48 into annular expansion chamber 68. Annular expansion chamber 68 essentially doubles the surface area of housing 30 which is exposed to the blast of exhaust gases resulting from the operation of fuse 12. Therefore, a great deal more heat is transferred to housing 30 and to the outer atmosphere in a short period of time. Inner cylindrical shell 64 may be relatively light weight because it ordinarily has an external pressure equal to or greater than its internal pressure. Further, this annular expansion chamber 68 provides an additional expansion chamber to initially receive exhaust gases.

Baffle plate 46, inner cylindrical shell 64, and vortex-producing baffle plate 66 form heat sink chamber 72. Positioned within heat sink chamber 72 is heat sink 74, which is formed of heat abosrbing material, preferably a roll of woven copper mesh, as is more specifically set forth in the chabala, et al., application. The melting, transporting, condensing, and remelting of the heat sink material, caused by the high temperature of the exhaust gases impinging upon heat sink 74 through openings 50 or 52 in baffle plate 46, result in the absorption of substantial energy by the heat sink material, thereby causing a substantial reduction in the exhaust gas temperature.

Figure 5:
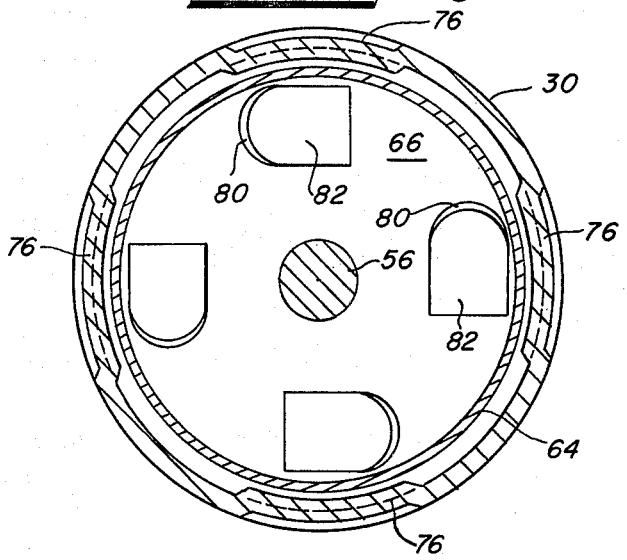
FIG. 5 is a cross-sectional view taken substantially along line 5—5 in FIG. 2.

Vortex-producing baffle plate 66, which is also coated with a corrosion resistant coating, is located downstream of heat sink chamber 72 and is held in place within housing 30 by means of crimps 76 and 78 in the same manner as that employed with respect to baffle plate 46 above and with the same advantages. Formed through and positioned radially around vortex-producing baffle plate 66 are openings 80, as shown in FIG. 5. Openings 80 are formed by a punch press operation, such that angularly disposed, flow directing vanes 82 are formed therein, as is more specifically set forth in the Chabala, et al., application. Exhaust gases flowing through openings 80 are diverted by vanes 82 toward the interior surface of housing 30, thereby causing circular flow within vortex chamber 84, formed by vortex-producing baffle plate 66, housing 30, and baffle plate 86. Baffle plate 86 is secured to central core pin 56 by rivet 88. Baffle plate 86 and pin 56 are also coated with a corrosion resistant coating. Spacer tube 90 surrounding central core pin 56 maintains the spacing between vortex-producing baffle plate 66 and baffle plate 86 to form vortex chamber 84 therebetween. Circular openings 92 are formed in baffle plate 86, as shown in FIG. 6.

Figure 6:
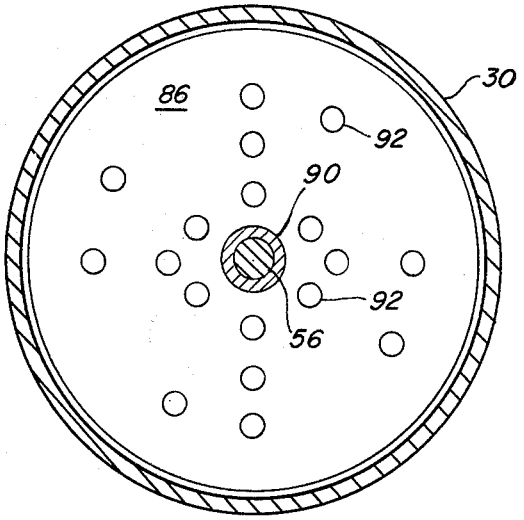
FIG. 6 is a cross-sectional view taken substantially along line 6—6 in FIG. 2.

With reference to FIG. 5 and FIG. 6, flow directing vanes 82 formed in vortex-producing baffle plate 66 are positioned directly above circular openings 92 formed in baffle plate 86 to prevent clogging or circular openings 92 by melted heat sink material 74 as the exhaust gases exit vortex chamber 84.

Outlet end wall 34 is attached to housing 30 by means of counterbore 94 and the rolling or folding of rim 96 of housing 30 over the circumference of outlet end wall 34. This folding operation does not damage or compromise the corrosion resistant properties of the corrosion resistant coating on housing 30. Exit ports 98 are formed through outlet end wall 34, as shown in FIG, 8, thereby permitting venting of the exhaust gases to the atmosphere.

Figure 7:
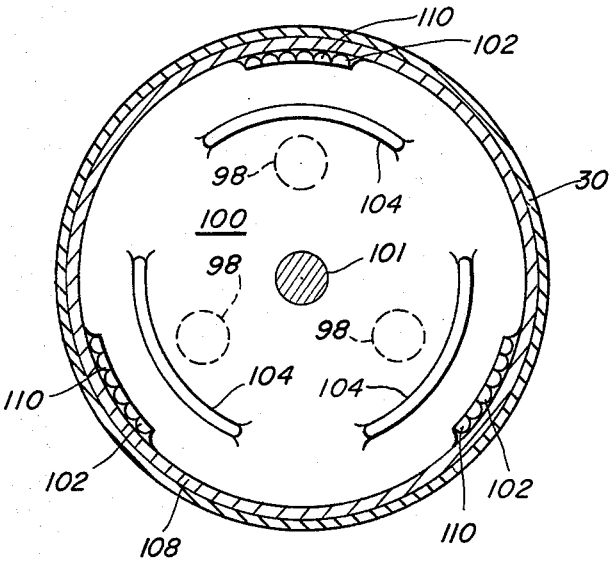
FIG. 7 is a cross-sectional view taken substantially along line 7—7 in FIG. 2.

Located adjacent to and upstream of outlet end wall 34 within housing 30 is labyrinth baffle plate 100, which is connected to outlet end wall 34 by rivet 101, or by other means such as a spotweld. Circumferential notches 102 are formed in labyrinth baffle plate 102, as shown in FIG. 7, to permit passage of exhaust gas therethrough. Arcuate ridges 104 are formed in labyrinth baffle plate 100, such that they are radially adjacent circumferential notches 102, as shown in FIG. 7. Outlet end wall 34 and labyrinth baffle plate 100 are rotationally oriented with respect to each other so that arcuate ridges 104 lie between circumferential notches 102 and exit ports 98, thereby forming exhaust gas diverting channels and setting up a labyrinth flow pattern. The exhaust gas must pass through circumferential notches 102, between labyrinth baffle plate 100 and outlet end wall 34 by going around arcuate ridges 104, and then out to the atmosphere through exit ports 98. Labyrinth baffle plate 100 is also coated with a corrosion resistant coating as are all of the other steel members of exhaust control device 10. Thus, corrosion of the steel members is avoided. The labyrinth baffle plate 100 disclosed herein constitutes an improvement over the similar plate disclosed in the copending Chabala, et al., application. The circumferential notches 102 provide an economic means of centering the plate within the housing and also reduce the number of arcuate ridges 104 necessary to provide effective operation since the notches provide an additional flow diverting channel. Further, this design permits use of an economical stamping operation to cut notches 102 and emboss ridges 104.

Absorbent chamber 106 is defined by labyrinth baffle plate 100, annular spacer member 108, and baffle plate 86. Absorbent chamber 106 is filled with absorbent material 110, which may be a variety of ceramic or other materials, capable of cooling the exhaust gas and absorbing water vapor and metallic vapor, as is more specifically set out in the Chabala, et al., application. Absorbent material 110 may conveniently be pellets of spherical shape, but other shapes, regular or irregular in nature, may be utilized. The preferred diameter and size of the absorbent material is disclosed in U.S. Pat. No. 3,719,912—Harner, et al. Steel wire mesh 112 prevents blockage of circular openings 92 in baffle plate 86 by absorbent material 110. The exhaust gas flowing through absorbent material 110 incurs substantial thermal energy loss by expansion and contraction of the gas flow through the voids and restrictions therein. Gaseous material is absorbed within the porous structure of absorbent material 110, thereby affecting an additional drop in the pressure and the temperature of the exhaust gas.

Exhaust control device 10 operates in the following manner. When fuse 12 operates, energy is produced in the form of heat, light, and sound, and hot exhaust gases are expelled through hollow base extension 44 of fuse 12. The arc produced during the operation of fuse 12 may be blown into exhaust control device 10 by the inrush of exhaust gases and this arc would tend to settle upon arcing tip 54, thereby preventing damage to housing 30 or to baffle plate 46. The quantity of energy produced by the operation of fuse 12 varies with the circuit voltage and magnitude of fault current being interrupted. If fuse 12 utilizes a fusible metallic element to interrupt current, the exhaust gases will contain metallic vapors produced by the fusion of the metallic element.

The hot exhaust gases are initially received in gas expansion chamber 48 between baffle plate 46 and inlet end wall 32. The hot exhaust gases then travel through circular openings 50 and circumferential slots 70 in baffle plate 46 and into heat sink chamber 72 and annular expansion chamber 68. Heat from the exhaust gases contained in gas expansion chamber 48 and annular expansion chamber 68 is transferred to housing 30 and to the outer atmosphere. Exhaust gases from annular expansion chamber 68 are fed back into gas expanson chamber 48 as the pressure in this chamber begins to drop as a result of exhaust gas passing through circular openings 50 into heat sink chamber 72. The fact that this trapped exhaust gas must exit through circumferential slots 70 delays the passing of the gas through the remainder of exhaust control device 10 thereby resulting in a reduction in the violence of the exhaust gas throughout the operation.

In heat sink chamber 72, the melting point of heat sink material 74 is typically reached in a very short time due to the high temperature of the exhaust gas passing therethrough. Consequently, some of the heat sink material 74 vaporizes and is carried by the exhaust gas downstream to be recondensed on the cooler parts of heat sink material 74 and then again remelted as the temperature rises downstream. This process repeats itself as the exhaust gases flow through heat sink material 74 causing substantial energy to be absorbed from the exhaust gases in the heat sink chamber 72, resulting in a substantial drop in the temperature of the exhaust gases.

The exhaust gases, rich with metallic vapors and carrying molten heat sink material downstream, pass through openings 80 in vortex-producing baffle plate 66. The hot exhaust gases impinge upon flow directing vanes 82 causing the gases to be directed toward the interior surface of vortex chamber 84. Since vortex chamber 84 is cylindrical, a forced circular gas flow results causing the heavy metallic particles and vapors to be deposited and condensed upon the interior surface of vortex chamber 84 by centrifugal force. Further, the diverting of the direction of flow of the exhaust gases absorbs additional energy by momentum-energy exchange.

The exhaust gases, now substantially free of most of the metal particles and vapors, and substantially cooled, pass through openings 92 in baffle plate 86, through steel wire mesh 112, and into absorbent chamber 106. Absorbent material 110 performs a multiplicity of functions. First, as an additional heat sink, it further cools the exhaust gases. Absorbent material 110 also absorbs some of the water vapor which is a by-product of the arc extinguishing material typically utilized in fuse 12. Moreover, absorbent material 11 attenuates the sound produced during operation of fuse 12 due to wave cancellation and cross flow channelling within absorbent material 110. In addition, absorbent material 110 filters out the remaining metallic or other solid debris which is not deposited on the walls of vortex chamber 84.

The exhaust gases then pass through circumferential notches 102 in labyrinth baffle plate 100 and around arcuate ridges 104 between labyrinth baffle plate 100 and outlet end wall 34. Further sound attenuation and energy absorption occurs at this stage due to sound wave cancellation and the repeated change of direction of the gas flow. The exhaust gases then escape through exit ports 98 to the atmosphere. At this point, a major portion of the heat, light, and sound energy of the exhaust gases has been dissipated in exhaust control device 10, thereby suppressing and attenuating the discharge of blasts of sound and incandescent gases as a result of the operation of fuse 12.

Figure 9:
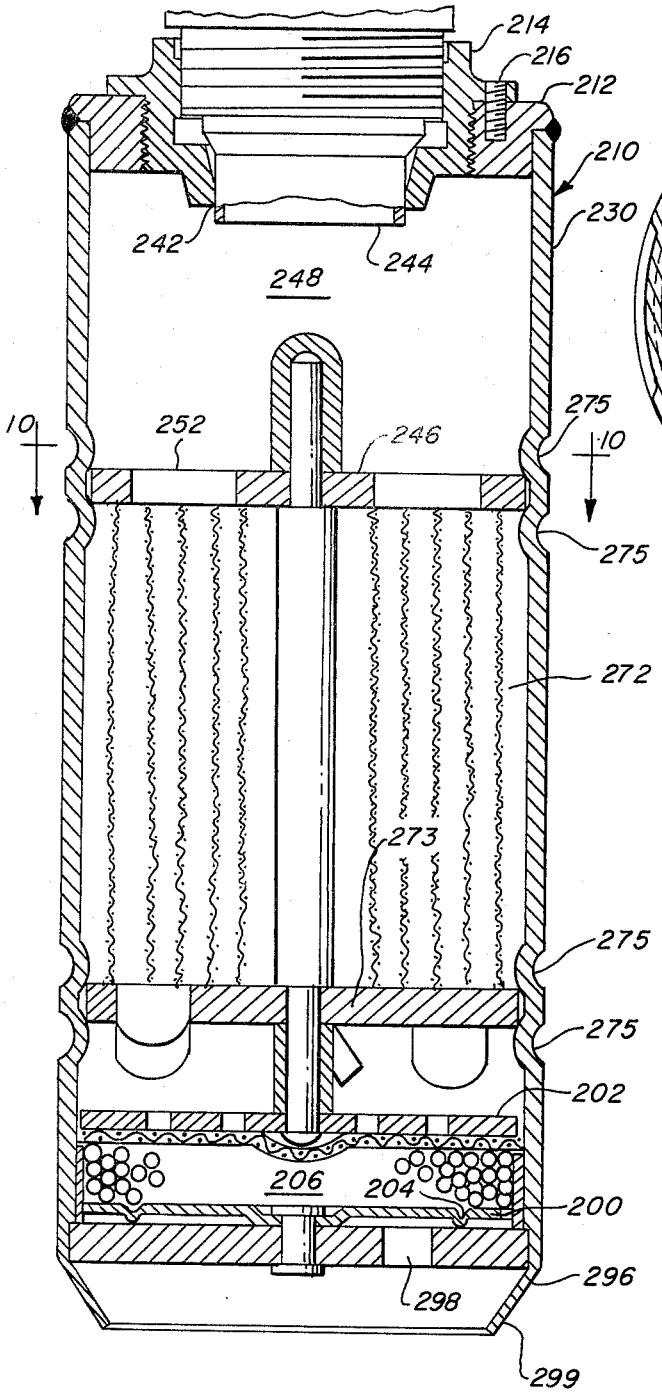
FIG. 9 is a cross-sectional view of an alternative embodiment of the present invention.

With reference to FIG. 9, an alternative embodiment of the present invention is illustrated. Inlet end wall 32 in the FIG. 2 embodiment is replaced in the FIG. 9 exhaust control device 210 by header 212 and adapter 214. Header 212, normally made of steel, is welded to steel housing 230 and then coated with a corrosion resistant coating, such as zinc, as an assembly along with housing 230. Adapter 214 is made of silver-plated brass or copper and threadedly engages header 212, with pin 216 securing adapter 214 by preventing relative rotation of adaptor 214 and header 212. The construction has the advantage of using a minimum amount of high cost materials such as silver-plated brass or copper for the adapter connecting exhaust control device 210 to fuse 12. It is necessary that the threaded connection between fuse 12 and exhaust control device 210 be corrosion free so that device 210 may be easily removed and replaced if necessary. If device 210 becomes corroded to fuse 12, device 210 may have to be replaced if fuse 12 needs replacement or renewal of its internal components.

Figure 10:
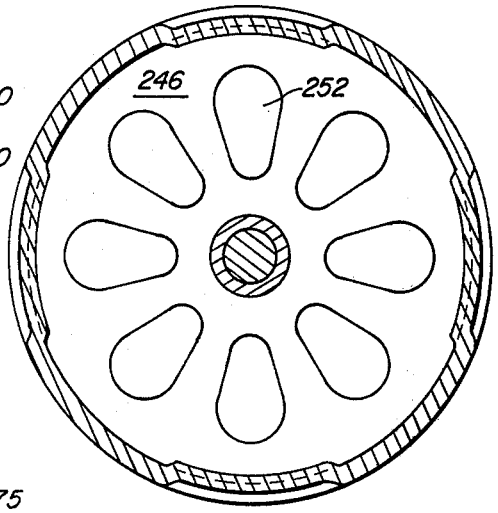
FIG. 10 is a cross-sectional view substantially along line 10—10 in FIG. 9.

Exhaust control device 210 further differs from the FIG. 2 embodiment in that exhaust control device 210 does not contain an annular expansion space 68 as found in FIG. 2. All exhaust gases must pass from gas expansion chamber 248 into heat sink chamber 272 by passing through tapered openings 252. Baffle plate 246, as shown in FIG. 10, does not contain circumerential slots as appeared on baffle plate 46 in FIG. 2.

Labyrinth baffle plate 200, vortex-producing baffle 273, and baffle plate 202 are substantially the same as the corresponding members described with respect to the FIG. 2 embodiment. Baffle plate 246 and vortex-producing baffle 273 are held in position by crimps 275 which provide the same advantages previously described with respect to the first embodiment of avoiding damage to the corrosion resistant coating on housing 230. As in the previous embodiment, the steel members are coated with a corrosion.

Rim 296 of housing 230 differs from rim 96 in the FIG. 2 embodiment in that rim 296 is flared to form annular apron 299 for directing the exhaust gases venting to the atmosphere through exit ports 298.

The operation of the FIG. 9 embodiment is substantially the same as that described with respect to the FIG. 2 embodiment, except for the changes described above.

Figure 11:
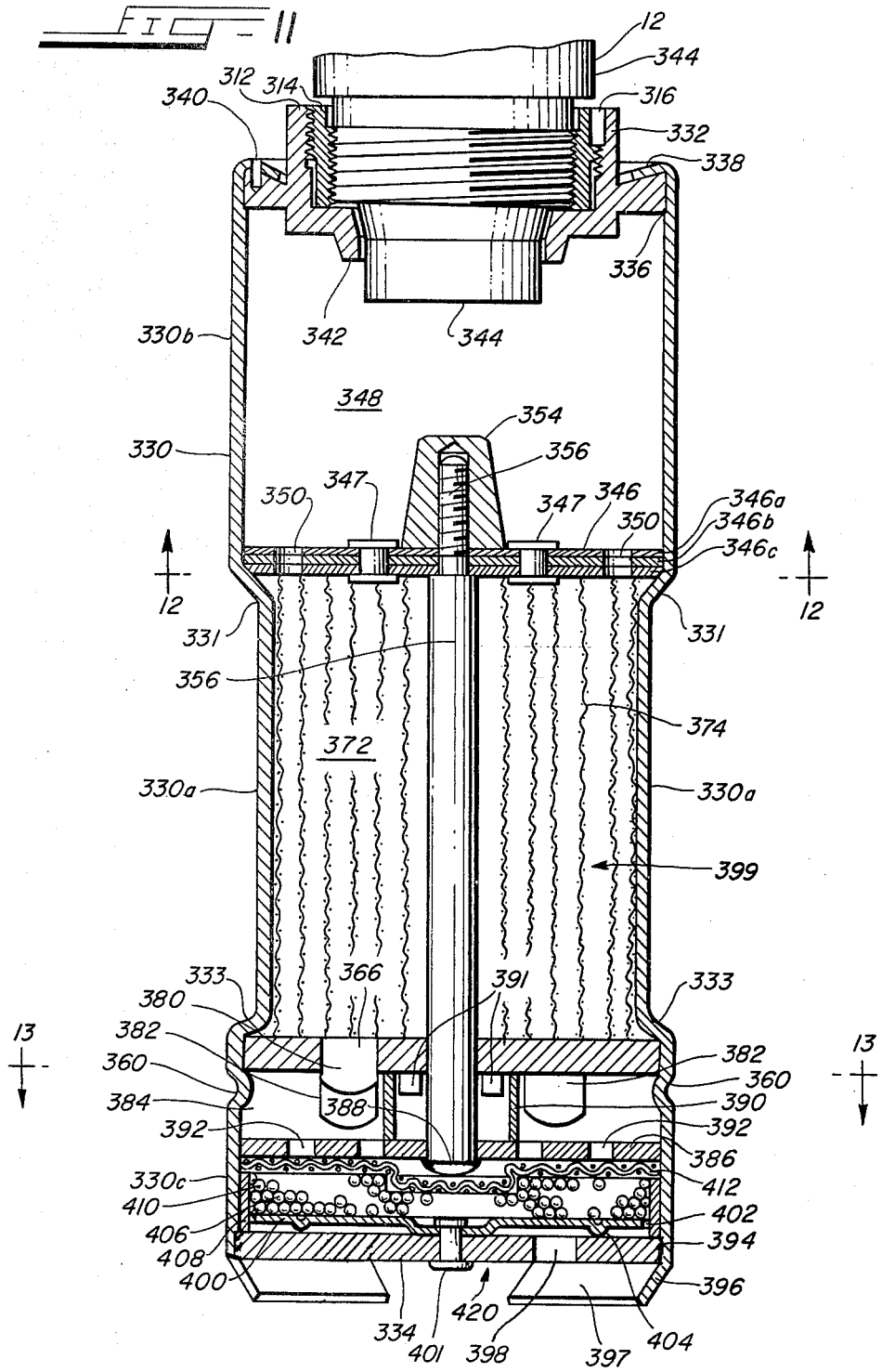
FIG. 11 is a cross-sectional view of a further embodiment of the present invention.

With reference to FIG. 11, a further embodiment of the present invention is illustrated. Exhaust control device 310 comprises hollow cylindrical housing 330, inlet wall assembly 332, and outlet end wall 334. Cylindrical housing 330 is composed of narrowed middle housing section **330*a*, which is centrally located between inlet end wall assembly 332 and outlet end wall 334, enlarged first housing section 330*b*, which is formed between inlet end wall assembly 332 and narrowed middle housing section 330*a*, and enlarged second housing section 330*c*, which is formed between narrowed middle housing section 330*a* and outlet end wall 334. Cylindrical housing 330 is composed of steel and coated with a corrosion resistant coating, such as zinc. Similarly, outlet end wall 334** is composed of steel and coated with a corrosion resistant coating.

Inlet end wall assembly 332 is composed of header 312 and adapter 314. Adapter 314 threadedly engages hollow base extension 344 of fuse 12. Adapter 314 is made of silver-plated brass or copper and threadedly engages header 312, with pin 316 securing adapter 314 by preventing the relative rotation of adapter 314 and header 312. Header 312, normally made of steel, is attached to housing 330 by means of counterbore 336 and the rolling or folding of rim 338 of housing 330 over the circumference of header 312. This folding operation does not damage or reduce the corrosion resistant properties of the coating. Pin 340 holds header 312 in place to prevent rotation within the annular indentation formed by counterbore 336 and rim 338.

This construction of inlet end wall assembly 332 has the advantage of using an even smaller amount of high cost materials such as silver-plated brass or copper for adapter 314 than is required for adapter 214 in FIG. 9 described above. The threaded connection between fuse 12 and exhaust control device 310 must be corrosion free so that device 310 may be easily removed and replaced if necessary and so that device 310 may be reused following the operation of fuse 12. If exhaust control device 310 becomes corroded to fuse 12, device 310 may have to be replaced when fuse 12 needs replacement or renewal of its internal components.

When fuse 12 operates to interrupt current flow, hot exhaust gases are expelled through hollow base extension 344 into gas expansion chamber 348 of exhaust control device 310, which is formed by inlet end wall assembly 332, cylindrical first housing section 330*b*, and baffle plate assembly 346. Baffle plate assembly 346 is adjacent to first peripheral rim 331 formed in cylindrical housing 330 between first housing section 330*b* and narrowed middle housing section 330*a*.

Figure 12:
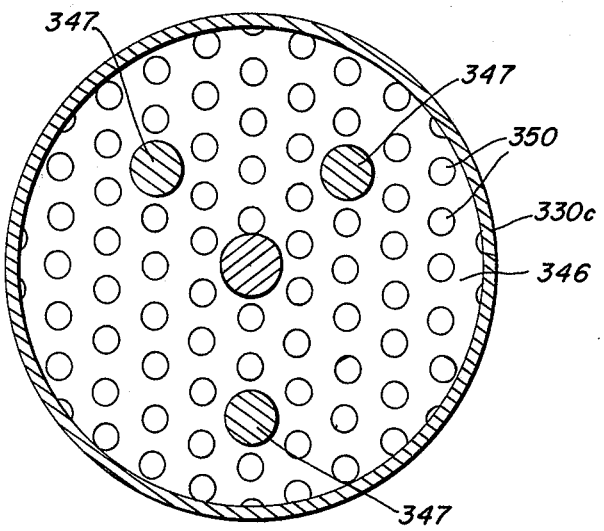
FIG. 12 is a cross-sectional view taken substantially along line 12—12 in FIG. 11.

Baffle plate assembly 346 is a lamination composed of three layers, 346*a*, 346*b*, and 346*c*, which are punched from perforated metal sheets and held together by rivets 347. With reference to FIG. 12, the large number of perforated holes 350 in baffle plate assembly 346 tend to equalize the flow of hot exhaust gases through baffle plate assembly 346 into heat sink chamber 372 resulting in the even erosion of heat sink material 374. The use of lamination of three layers punched from perforated metal is more economical than the tooling required for the production of a single thickness baffle with the same number of small diameter holes.

Mounted at the center of baffle plate assembly 346 is arcing tip 354 which serves as a point upon which an electrical arc blown into exhaust control device 310 can settle. Without arcing tip 354, the electrical arc could settle on the interior of cylindrical first housing 330*b* and burn a hole therethrough, which would result in component failure. Arcing tip 354 is threadedly secured to central core pin 356.

Baffle plate assembly 346, narrowed middle housing section 330*a*, and vortex-producing baffle plate 366 form heat sink chamber 372. Positioned within heat sink chamber 372 is heat sink 374, which is formed of heat absorbing material, preferably a roll of woven copper mesh, as is more specifically set forth in the Chabala, et al., application.

Vortex-producing baffle plate 366, which is coated with a corrosion resistant material, is positioned adjacent to second peripheral rim 333 formed in cylindrical housing 330 between narrowed middle housing section 330*a* and second housing section 330*c*. Formed through and positioned radially around vortex-producing baffle plate 366 are openings 380 formed by a punch press operation, such that angularly disposed, flow directing vanes 382 are formed therein, as shown in FIG. 5 and as is more specifically set forth in the Chabala, et al., application. Exhaust gases flowing through openings 380 are diverted by vanes 382 toward the interior surface of second housing section 330*c*, thereby causing circular flow within vortex chamber 384, formed by vortex-producing baffle plate 366, second housing section 330*c*, and baffle plate 386. Baffle plate 386 is secured to central core pin 356 by rivet 388. Baffle plate 386 and pin 356 are also coated with a corrosion resistant coating. Spacer tube 390 surrounding central core pin 356 maintains the spacing between vortex-producing baffle plate 366 and baffle plate 386 to form vortex chamber 384 therebetween. Flow directing vanes 382 formed in vortex-producing baffle plate 366 are positioned directly above circular openings 392 formed in baffle plate 386, as shown in FIG. 6, so that hot exhaust gases and melted heat sink material 374 entering vortex chamber 384 are not blown directly onto circular openings 392. This prevents clogging of circular openings 392.

Figure 13:
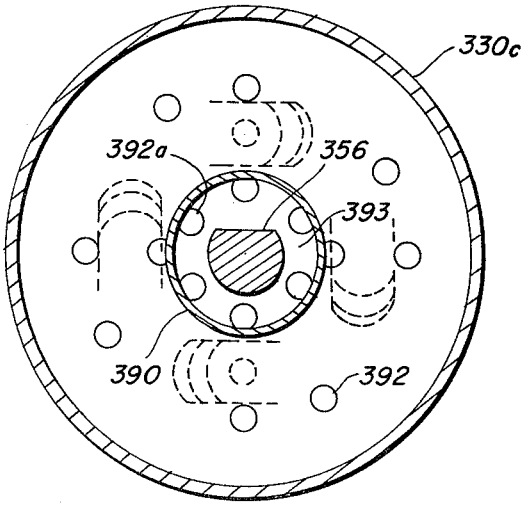
FIG. 13 is a cross-sectional view taken substantially along line 13—13 in FIG. 11.

With reference to FIG. 13, auxiliary conduit 393, is formed within spacer tube 390 between vortex-producing baffle plate 366 and baffle plate 386. Notches 391, as shown in FIG. 11, are formed on one end of spacer tube 390 and are positioned adjacent to vortex-producing baffle plate 366. Notches 391 provide the means whereby exhaust gases can enter auxiliary conduit 393 from vortex chamber 384 should holes 392 in baffle plate 386 become clogged as a result of repeated operation of exhaust control device 310. Exhaust gases exit auxiliary conduit 393 through centrally located holes 392*a* in lower baffle plate 386.

Baffle plate assembly 346, vortex-producing baffle plate 366, spacer tube 390, and baffle plate 386 are held together around central core pin 356 by arcing tip 354 and rivet 388 to form internal unit 399. Internal unit 399 is secured within housing 330 by baffle assembly 346, which is held against first peripheral rim 331, and by vortex-producing baffle plate 366, which is held against second peripheral rim 333. Crimp 360 in lower housing section 330*c*, located adjacent to and on the downstream side of vortex-producing baffle plate 366 opposite first peripheral rim 333, also acts to secure internal unit 399 within housing 330 by preventing the downward movement of vortex-producing baffle plate 366. Crimp 360 need not encompass the entire circumference of housing 330 but may be segmented as shown in FIGS. 3 and 4. The crimps may be relatively shallow and may be formed by means of a pressing operation. With properly contoured forming dies, the coated finish, which is required to prevent corrosion of steel housing 330, will not suffer damage, and the corrosion resistance of housing 330 will not be damaged or compromised. This is especially important because exhaust control device 310 will typically be exposed to extremes of temperataure and humidity and to corrosive atmospheres. If a welding operation were used to mount the various elements in housing 330, heat would affect the corrosion resistant coating eventually resulting in corrosion damage to the exhaust control device.

Absorbent chamber 406 is defined by baffle plate 386 annular spacer member 408, and labyrinth baffle plate 400. Absorbent chamber 406 is filled with absorbent material 410, which may be a variety of ceramic or other materials, capable of cooling the exhaust gas and absorbing water vapor and metallic vapor, as is more specifically set out with respect to FIG. 2 above. Steel wire mesh 412 prevents blockage of circular openings 392 in baffle plate 386 by absorbent material 410. The exhaust gas flowing through absorbent material 410 incurs substantial thermal energy loss by expansion and contraction of the gas flow through the voids and restrictions therein. Gaseous material is absorbed within the porous structure of absorbent material 410, thereby affecting an additional drop in the pressure and the temperature of the exhaust gas.

Figure 8:
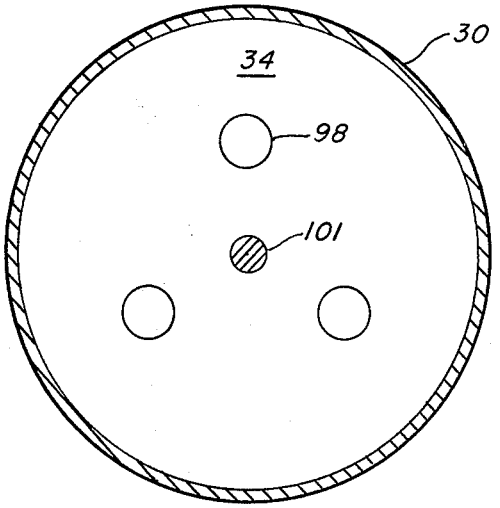
FIG. 8 is a cross-sectional view taken substantially along line 8—8 in FIG. 2.

Labyrinth baffle plate 400 and outlet end wall 334 combine to form labyrinth exit assembly 420. Labyrinth baffle plate 400 is located adjacent to and upstream of outlet end wall 334 within second housing section 330*c* and is connected to outlet end wall 334 by rivel 401 or by other means such as a spot-weld. Circumferential notches 402 are formed in labyrinth baffle plate 400, as shown in FIG. 7, to permit passage of exhaust gas therethrough. Arcuate ridges 404 are formed in labyrinth baffle plate 400, such that they are radially adjacent circumferential notches 402, as shown in FIG. 7. Exit ports 398 formed through outlet end wall 334, as shown in FIG. 8, permit venting of the exhaust gases to the atmosphere. Outlet end wall 334 and labyrinth baffle plate 400 are rotationally oriented with respect to each other so that arcuate ridges 404 lie between circumferential notches 402 and exit ports 398, thereby forming exhaust gas diverting channels and setting up a labyrinth flow pattern. The exhaust gases exit absorbent chamber 406 through circumferential notches 402, between labyrinth baffle plate 400 and outlet end wall 334 by going around arcuate ridges 404, and then out to the atmosphere through exit ports 398.

Labyrinth baffle plate 400 is also coated with a corrosion resistant coating as are all of the other steel members of exhaust control device 310. Thus, corrosion of the steel members is avoided. The labyrinth baffle plate 400 disclosed herein constitutes an improvement over the similar plate disclosed in the copending Chabala, et al., application, as noted above with reference to FIG. 2.

Outlet end wall 334 is attached to lower housing section 330*c* by means of counterbore 394 and the folding of rim 396 of second housing section 330*c'* over the circumference of outlet end wall 334. This folding operation does not damage or compromise the corrosion resistant properties of the corrosion resistant coating on cylindrical housing 330. Rim 396 of second housing section 330*c* is flared to form annular apron 397 for directing the exhaust gases venting to the atmosphere through exit ports 398.

Exhaust control device 310 operates in substantially the same manner as exhaust control device 10 described above with reference to FIG. 2. Enlarged first and second housing sections 330*b* and 330*c* provide the benefits of increased volume and larger cross-sectional area during the entrance and exit of the exhaust gases. The volumne and cross-section of narrowed middle housing section 330*a* is consistent with the required size and shape of heat sink material 374. This configuration of cylindrical housing 330 and internal unit 399 provides additional strength and economy in the construction of exhaust control device 310.

The principal advantages of the present invention are that an exhaust control device of simple and economical manufacture utilizing limited amounts of expensive materials which substantially eliminates corrosion problems is possible. As pointed out previously, the internal baffles may be held in place by a crimping operation that does not damage the corrosion resistant coating on the housing. Further, the folding or rolling operation to hold the end walls in position facilitates economical manufacture and also does not damage or compromise the corrosion resistant coating. Moreover, since it is desirable to utilize as little expensive material as possible for economic considerations, the use of a steel header 212 or 312, which may be coated to prevent corrosion, allows smaller volumes of expensive corrosion resistant materials to be used in adapter 214 or 314 so that a corrosion free junction between the fuse and the exhaust control device may be assured without unnecessary expense.

In addition, the provision of an additional annular expansion chamber 68 provides advantages over prior constructions since an additional chamber initially receives exhaust gases, thereby reducing turbulent flow downstream. Similarly, the surface area of the housing wall exposed to the hot exhaust gases is substantially increased, thereby causing greater heat transfer to the atmosphere resulting in less heat absorption required by the remaining elements of the exhaust control device. Thus, the life of the exhaust control device is increased.

It should be expressly understood that various modifications and changes can be made to the structure of the present invention as illustrated in the accompanying drawings, especially to the internal structure, without departing from the spirit and scope of the present invention as defined in the appended claims.

We claim:

1. An exhaust control device for a circuit interrupter comprising:

a hollow housing having a corrosion resistant coating thereon;

an inlet end wall having an intake port formed therein for receiving a stream of hot exhaust gases incident to the operation of the circuit interrupter, said inlet end wall held in place within one end of said hollow housing by folding said hollow housing over said inlet end wall so that the corrosion resistant coating on said housing is not damaged;

at least one baffle for partitioning said hollow housing into a plurality of chamber for cooling and filtering the hot exhaust gases, for changing the flow of the hot exhaust gases, and for attenuating sound, said at least one baffle held in place within said hollow housing by the crimping of said hollow housing adjacent to said at least one baffle so that the corrosion resistant coating is not damaged;

an outlet end wall having a corrosion resistant coating thereon, and having one or more exit ports formed therein, for allowing the exhaust gases to escape to the atmosphere, said outlet end wall held in place within the other end of said hollow housing by folding said hollow housing over said outlet end wall so that the corrosion resistant coating on said housing is not damaged.

2. An exhaust control device, as claimed in claim 1, wherein said hollow housing is cylindrical in shape.

3. An exhaust control device, as claimed in claim 1, wherein said inlet end wall comprises:

a header means formed of a material subject to corrosion mounted within said hollow housing and having a corrosion resistant coating thereon; and an adapter means composed of a corrosion resistant material mounted within said header means for engaging the circuit interrupter.

4. An exhaust control device, as claimed in claim 3, wherein said corrosion resistant material is brass.

5. An exhaust control device, as claimed in claim 3, wherein said corrosion resistant material is copper.

6. An exhaust control device, as claimed in claim 3, wherein said header means threadedly engages said adpater means.

7. An exhaust control device, as claimed in claim 1, wherein said inlet end wall is composed of a corrosion resistant material.

8. An exhaust control device, as claimed in claim 7, wherein said corrosion resistant material is brass.

9. An exhaust control device, as claimed in claim 7, wherein said corrosion resistant material is copper.

10. An exhaust control device, as claimed in claim 1, which further comprises:

a first expansion chamber formed between said hollow housing, said inlet end wall and a first baffle plate; and a peripheral expansion chamber formed between said hollow housing, said first baffle plate, a second baffle plate, and an inner shell, said peripheral expansion chamber communicating with said first expansion chamber by means of peripheral slots in said first baffle plate.

11. An exhaust control device, as claimed in claim 2, which further comprises:

a first expansion chamber formed between said hollow cylindrical housing, said inlet end wall and a first baffle plate; and an annular expansion chamber formed between said hollow cylindrical housing, said first baffle plate, a second baffle plate, and an inner cylindrical shell, said annular expansion chamber communicating with said first expansion chamber by means of circumferential slots in said first baffle plate.

12. An exhaust control device, as claimed in claim 1, which further comprises a labyrinth baffle means, for changing the direction of flow of the exhaust gases and for attenuating sound, positioned within said hollow housing adjacent to said outlet end wall, comprising:

a baffle plate positioned within said hollow housing adjacent to and upstream of said outlet end wall;

a plurality of notches formed on the periphery of said baffle plate, which permit exhaust gas flow from the chamber directly upstream of said baffle plate; and a plurality of ridges formed on the interior area of said baffle plate and extending between said baffle plate and said outlet end wall and radially adjacent to said peripheral notches and radially adjacent to said exit ports formed in said outlet end wall, thereby forming gas flow diverting channels and a labyrinth flow pattern for the exhaust gases being vented to the atmosphere through said exit ports.

13. An exhaust control device, as claimed in claim 2, which further comprises:

a baffle plate positioned within said hollow cylindrical housing adjacent to and upstream of said outlet end wall;

a plurality of notches formed on the circumference of said baffle plate, which permit exhaust gas flow from the chamber directly upstream of said baffle plate; and a plurality of arcuate ridges formed on the interior area of said baffle plate and extending between said baffle plate and said outlet end wall and radially adjacent to said exit ports formed in said outlet end wall, thereby forming gas flow diverting channels and a labyrinth flow pattern for the exhaust gases being vented to the atmosphere through said exit ports.

14. An exhaust control device for a circuit interrupter comprising:

a hollow housing having a corrosion resistant material coated thereon and having a narrowed portion centrally thereof thereby forming a first and a second peripheral surface in said housing;

an inlet end wall having an intake port formed therein for receiving a stream of hot exhaust gases incident to the operation of the circuit interrupter, said inlet end wall held in place within one end of said hollow housing by folding said hollow housing over said inlet end wall so that the corrosion resistant coating on said housing is not damaged;

a first expansion chamber formed between said inlet end wall, said hollow housing and a first baffle plate, said first baffle plate supported by said first peripheral surface formed within said hollow housing;

a heat sink chamber formed between said first baffle plate, said narrowed portion of said hollow housing and a second baffle plate, said second baffle plate supported by said second peripheral surface within said hollow housing; and an outlet end wall having a corrosion resistant material coated thereon, and having one or more exit ports formed therein, for allowing the exhaust gases to escape to the atmosphere, said outlet end wall held in place within the other end of said hollow housing by folding said hollow housing over said outlet end wall so that the corrosion resistant coating on said housing is not damaged.

15. An exhaust control device, as claimed in claim 14, wherein said hollow housing is cylindrical in shape.

16. An exhaust control device, as claimed in claim 14, wherein said inlet end wall is composed of a corrosion resistant material.

17. An exhaust control device, as claimed in claim 16, wherein said corrosion resistant material is brass.

18. An exhaust control device, as claimed in claim 16, wherein said corrosion resistant material is copper.

19. An exhaust control device, as claimed in claim 14, wherein said inlet end wall comprises:

a header means formed of a material subject to corrosion mounted within said hollow housing and having a corrosion resistant coating thereon; and an adapter means composed of a corrosion resistant material mounted within said header means for engaging the circuit interrupter.

20. An exhaust control device, as claimed in claim 19, wherein said corrosion resistant material is brass.

21. An exhaust control device, as claimed in claim 19, wherein said corrosion resistant material is copper.

22. An exhaust control device, as claimed in claim 19, wherein said header means threadedly engages said adapter means.

23. An exhaust control device, as claimed in claim 14, wherein at least said first baffle comprises a plurality of layers which have been puched from sheets of metal with a multiplicity of perforations formed therein.

24. An exhaust control device, as claimed in claim 14, wherein said second baffle is held in place within said hollow housing by the crimping of said hollow housing adjacent to said second baffle so that the corrosion resistant coating on said housing is not damaged.

25. An exhaust control device, as claimed in claim 24, which further comprises a core pin centrally located within said hollow housing, which connects said first baffle and said second baffle, thereby providing additional support for said first baffle and said second baffle within said hollow housing.

26. An exhaust control device, as claimed in claim 14, which further comprises a labyrinth baffle means, for changing the direction of flow of the exhaust gases and for attenuating sound, positioned within said hollow housing adjacent to said outlet end wall, comprising:

a third baffle plate positioned within said hollow housing adjacent to and upstream of said outlet end wall;

a plurality of notches formed on the periphery of said baffle plate, which permit exhaust gas flow from the chamber directly upstream of said third baffle plate; and a plurality of ridges formed on the interior area of said third baffle plate and extending between said baffle plate and said outlet end wall and radially adjacent to said peripheral notches and radially adjacent to said exit ports formed in said outlet end wall, thereby forming gas flow diverting channels and a labyrinth flow pattern for the exhaust gases being vented to the atmosphere through said exit ports.

27. An exhaust control device, as claimed in claim 15, which further comprises:

a third baffle plate positioned within said hollow cylindrical housing adjacent to and upstream of said outlet end wall;

a plurality of notches formed on the circumference of said third baffle plate, which permit exhaust gas flow from the chamber directly upstream of said baffle plate; and a plurality of arcuate ridges formed on the interior area of said third baffle plate and extending between said baffle plate and said outlet end wall and radially adjacent to said exit ports formed in said outlet end wall, thereby forming gas flow diverting channels and a labyrinth flow pattern for the exhaust gases being vented to the atmosphere through said exit ports.

* * * * *

UNITED STATES PATENT OFFICE

CERTIFICATE OF CORRECTION

Patent No. 4,001,750 Dated January 4, 1977

Inventor(s) Henry W. Scherer and Roy T. Swanson

It is certified that error appears in the above-identified patent and that said Letters Patent are hereby corrected as shown below:

Column 3, line 5, "partial" should read --partially--.

Column 5, line 3, "chabala" should read --Chabala--.

Column 5, line 38, "or" should read --of--.

Column 7, line 3, "gas" should read --gases--.

Column 7, line 36, "11" should read --110--.

Column 7, line 66, "The" should read --This--.

Column 8, line 26, after "corrosion" insert --resistant coating to avoid corrosion--.

Column 8, line 38, after "inlet" insert --end--.

Column 11, line 44, "volumne" should read --volume--.

Signed and Sealed this

Seventeenth Day of May 1977

[SEAL]

*Attest:*

RUTH C. MASON
*Attesting Officer*

C. MARSHALL DANN
*Commissioner of Patents and Trademarks*